United States Patent [19]

Russell

[11] 4,262,486

[45] Apr. 21, 1981

[54] COMBUSTION CHAMBERS

[75] Inventor: Robert L. J. Russell, Lutterworth, England

[73] Assignee: Rolls-Royce Limited, London, England

[21] Appl. No.: 53,309

[22] Filed: Jun. 29, 1979

[30] Foreign Application Priority Data

Aug. 19, 1978 [GB] United Kingdom ..... 33941/78

[51] Int. Cl.[3] ..... F02C 7/22

[52] U.S. Cl. ..... 60/746; 239/404

[58] Field of Search ..... 60/740, 746; 239/404, 239/428, 402.5

[56] References Cited

U.S. PATENT DOCUMENTS

| | | | |
|---|---|---|---|
| 3,361,182 | 1/1968 | Pillard | 239/402.5 |
| 3,512,359 | 5/1970 | Pierce | 60/748 |
| 3,834,159 | 9/1974 | Vdoviak | 60/746 |

*Primary Examiner*—Robert E. Garrett

*Attorney, Agent, or Firm*—Cushman, Darby & Cushman

[57] ABSTRACT

A combustion chamber arrangement for a gas turbine engine which can be annular or can-annular, though the annular arrangement is preferred, comprises in the annular form, an annular combustion chamber having in its upstream end a plurality of primary air inlets with associated swirling means, such as a ring of swirl vanes and a plurality of fuel injectors located in fuel injector apertures, the fuel injectors and primary air inlets being arranged so that at least two primary air inlets are located between any two fuel injectors, the primary air all being swirled in one direction so that the fuel from one injector is sheared in opposing directions by the swirling primary air from adjacent primary air inlets. Little or no air enters the combustion chamber in the region of the fuel injectors and any air that does enter in that region is not swirled.

8 Claims, 8 Drawing Figures

Figure 1:
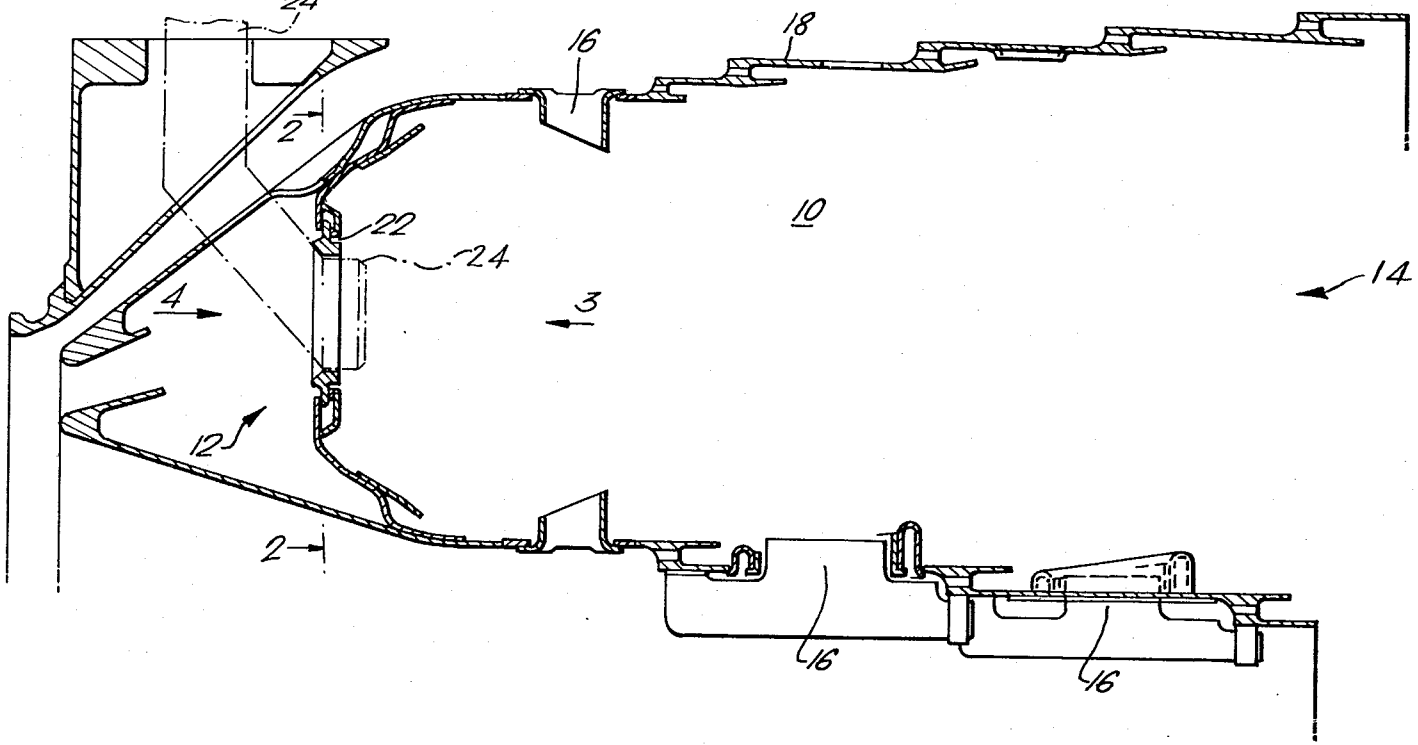

20
24
26
40
24
26
20
20
26
22
22
40
40
26

48
44
42
46
48

28

X
46
36
38
28
34
32
28
44
42

COMBUSTION CHAMBERS

This invention relates to combustion chambers particularly for use in gas turbine engines and is concerned with enabling such combustion chambers to operate on low grade fuels, such as diesel whilst keeping the emissions of smoke or carbon particles to acceptable levels. Many methods of controlling smoke or carbon particles have been proposed and tested for example, utilising very high combustion temperatures, having a relatively weak fuel/air mixture in the primary zone, staged fuel injection and improving the mixing of fuel and air in the primary zone to obtain a more homogeneous fuel/air mixture.

The present invention is concerned with providing a combustion chamber with improved means for mixing fuel and air in the primary zone of the combustion chamber.

According to the present invention there is provided a combustion chamber arrangement for a gas turbine engine comprising at least one combustion chamber; the or each combustion chamber having a closed upstream end, an open downstream end, inlets in the walls thereof for the flow of dilution air, the closed upstream end having a ring of circumferentially arranged primary air inlet apertures and at least one fuel inlet aperture, the or each fuel inlet aperture being arranged to receive a fuel injector means, each primary air inlet aperture having means for imparting a swirling motion to the primary air, the ring of primary air inlet apertures being associated with at least one fuel inlet aperture.

In a preferred arrangement, the invention provides an annular combustion chamber having a closed upstream end and an open downstream end, inlets in the walls thereof for the flow of dilution air, the closed upstream end having a ring of circumferentially arranged primary air inlet apertures interspersed with a ring of fuel inlet apertures, each fuel inlet aperture being arranged to receive a fuel injector means, each primary air inlet aperture having means for imparting a swirling motion to the primary air, one or more of the primary air inlet apertures being arranged between any two of the fuel inlet apertures.

Two primary air inlet means may be arranged between any two of the fuel inlet apertures and the primary air swirling means may comprise a number of angled vanes.

The swirling means may be arranged so that the direction of rotation of the swirling primary air is the same for each air inlet aperture or the swirling means may be arranged so that the direction of rotation of the swirling air from some of the air inlet means is opposite to that of the primary air issuing from the remaining air inlet apertures.

Each primary air inlet may have a deflector which acts to control both the angle at which the swirling primary air enters the combustion chamber and the spread of the mass of swirling primary air.

Figure 2:
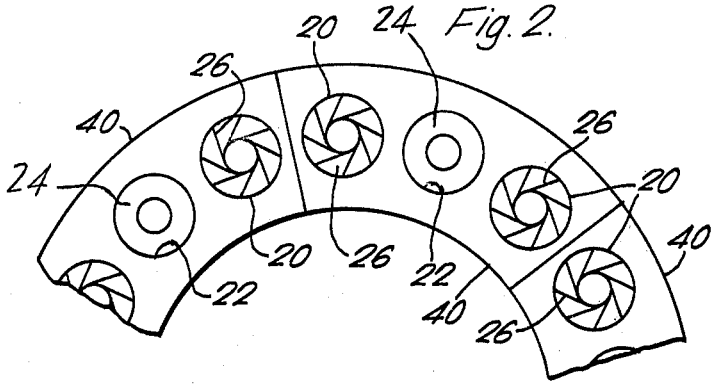
Figure 5:
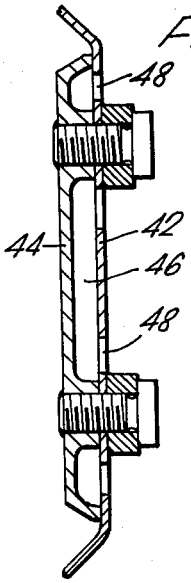
Figure 7:
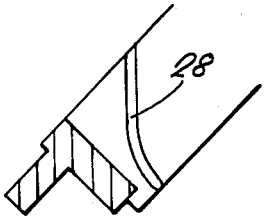
Figure 6:
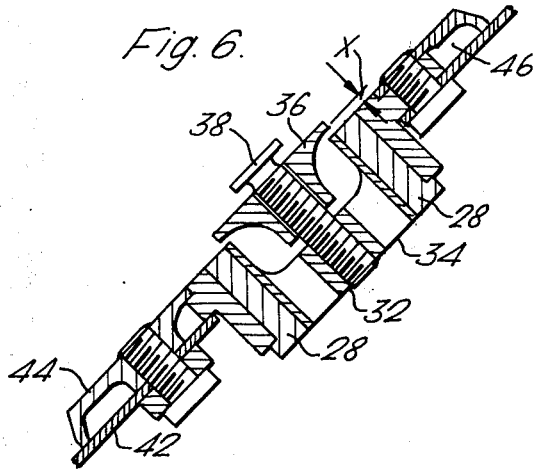
Figure 3:
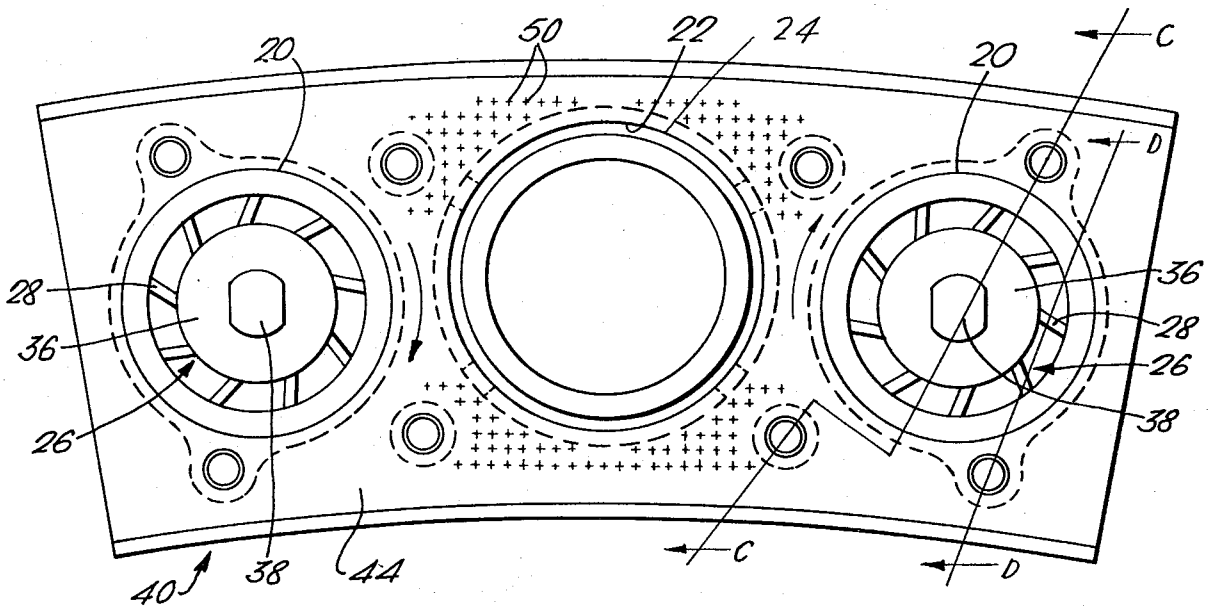
Figure 4:
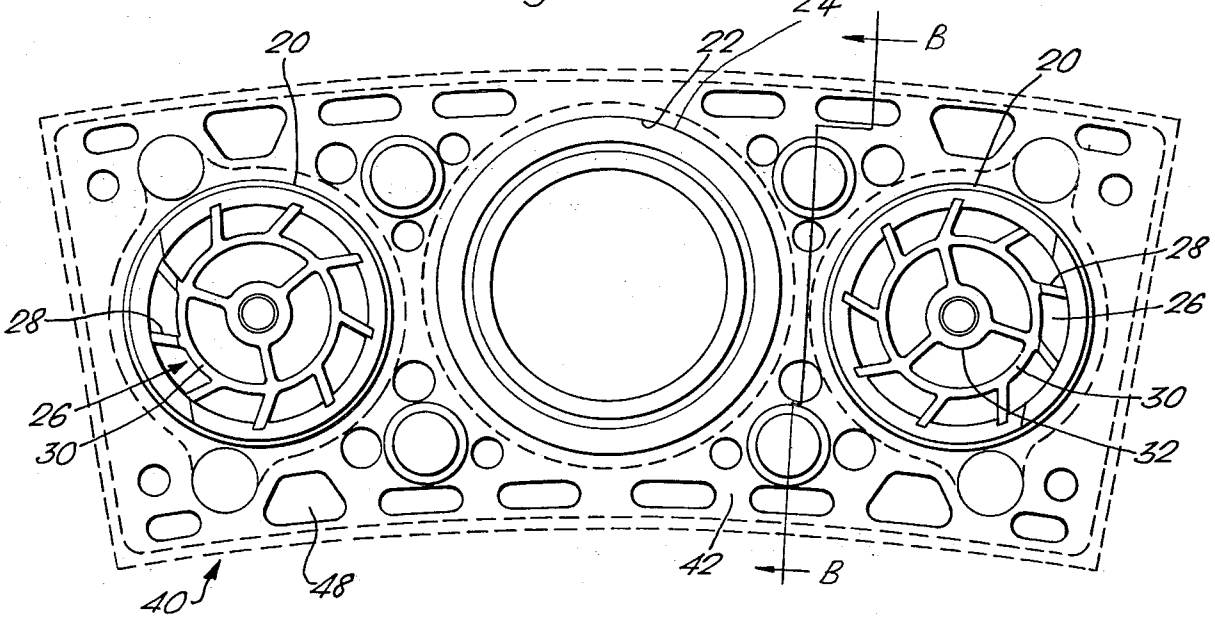
Figure 8:
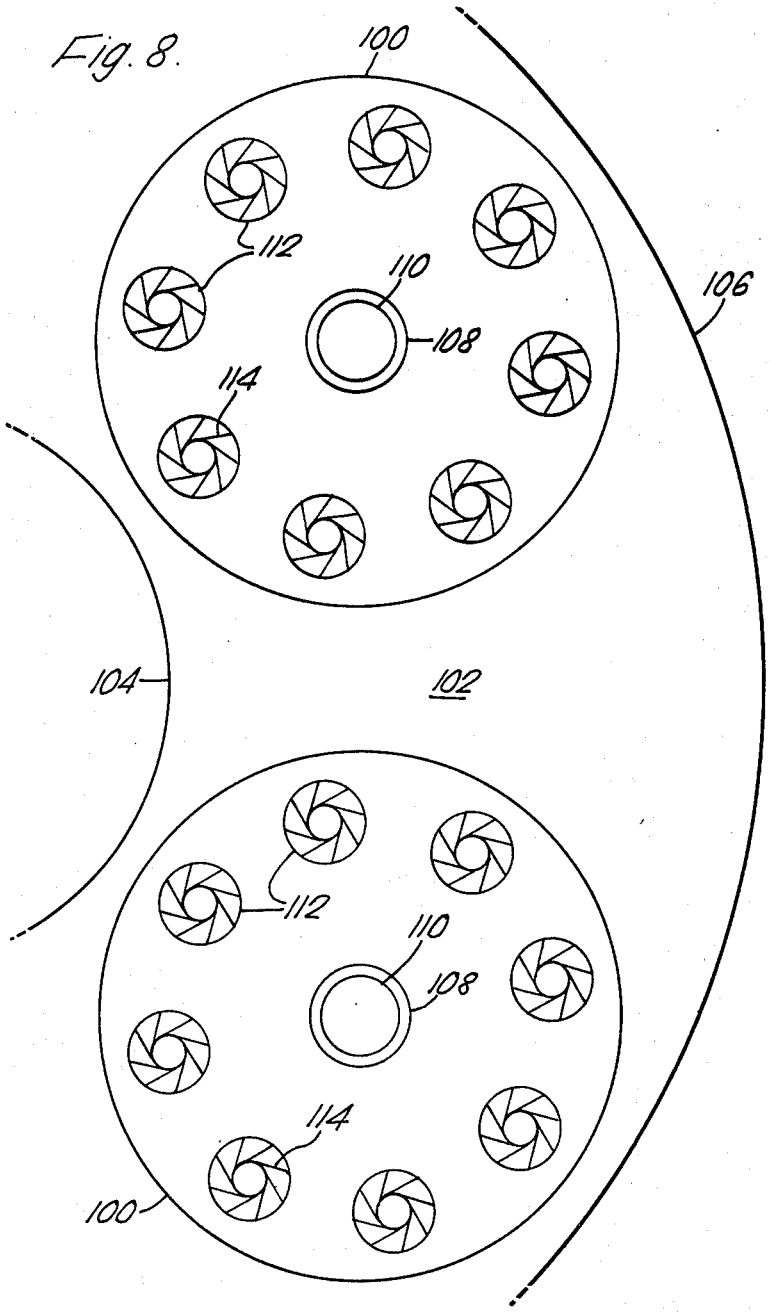

The present invention will now be more particularly described with reference to the accompanying drawings in which;

FIG. 1 shows an elevation of one form of combustion chamber according to the present invention, FIG. 2 is a partial section to a smaller scale on line 2—2 in FIG. 1, FIG. 3 is a view on arrow '3' in FIG. 1, FIG. 4 is a view on arrow '4' in FIG. 1, FIG. 5 is a section on line B—B in FIG. 4, FIG. 6 is a section on line C—C in FIG. 3, FIG. 7 is a section line D—D in FIG. 3, FIG. 8 shows a further combustion chamber according to the present invention.

Referring to FIGS. 1 through 7, inclusive, an annular combustion chamber 10 for a gas turbine engine (not shown) comprises a closed upstream end 12, an open downstream end 14 and a plurality of inlet 16 in walls 18 for the inflow of dilution air.

The upstream end 12 has a ring of circumferentially spaced primary air inlet apertures 20 (FIG. 2) interspersed with fuel inlet apertures 22, in each of which apertures an airspray fuel injector 24 (shown diagrammatically) is located. Each primary air inlet aperture 20 has a swirler means 26 which is arranged to impart a swirling motion to the primary air as it enters the combustion chamber, all the swirlers 26 giving the primary air the same direction of rotation.

Each swirler comprises a number of angled vanes 26 supported by a ring 30 (FIG. 4) which itself supports a central boss 32 by means of three arms 34. A deflector or pintle 36 is adjustably mounted on a bolt 38 which is screwed into the boss 32.

The air inlet apertures 20 and fuel inlet apertures 22 are arranged in assemblies 40, each assembly comprising a fuel inlet aperture 22 flanked by an air inlet aperture 20 on each side.

When the assemblies are placed together to form the upstream end 12 of the combustion chamber any two fuel inlet apertures have two air inlet apertures between them.

Each assembly 40 (see particularly FIGS. 3, 4 and 5) comprises a base plate 42 and a front plate 44 which between them define a plenum chamber 46. The base plate 42 has a plurality of apertures 48 through which cooling air can flow into the plenum chamber and thus cool the plate 44, the cooling air then passes out of the plenum chamber through a large number of relatively small diameter holes 50 (FIG. 3).

In operation, fuel and unswirled air enters the combustion chamber through the fuel injectors 24 and primary air from the compressor of the gas turbine engine enters through the swirlers 26. The fuel from each injector becomes rapidly entrained with the mass of swirling air entering through the swirler on each side of it. Because the swirlers each rotate the primary air in the same direction, the fuel from each injector tends to be sheared into, two parts, one part being entrained with the primary air entering on one side of the fuel injector and the other part being entrained with the primary air entering on the other side of the fuel injector. This can be illustrated by reference to FIG. 3, in which it will be seen that the left hand swirler tends to pick up the fuel from the left hand side of the fuel injector and direct it towards the inner wall of the combustion chamber whilst the right hand air swirler tends to pick up the fuel from the right hand side of the fuel injector and direct it towards the outer wall of the combustion chamber. The fuel and air thus became intimately mixed in a relatively short time and in a relatively small volume.

The pintles 36 also operate to control the angle at which the swirling mass of primary air enters the combustion chamber and also acts to confine the downstream spread of the primary air. This is achieved by a momentum balance of swirler and pintle airflows arrived at by adjusting the pintle outlet gap (X in FIG. 6) thus resulting in a larger swirler exit angle with consequent high air to fuel shear areas in a very short downstream distance. The deflectors whilst assisting in the control of the primary air, are not essential to the satisfactory operation of the invention and may be omitted, if desired. However, the use of a device such as the pintle for the control outlined above is most useful, and for a given swirler surface area allows larger quantities of air to be mixed within a short time and in a relatively small volume, i.e., close to the upstream end of the combustion chamber and consequently the fuel injection points.

A combustion chamber according to the invention has been found to operate on diesel fuel without producing black smoke at any power or white smoke at the engine idle condition, whilst also improving combustion efficiency at idle.

The invention has been described above showing two air inlet apertures between two adjacent fuel inlet apertures, but the number of primary air inlet apertures between any two adjacent fuel inlet apertures can be varied to suit the circumstances, provided at least one primary air inlet aperture is located between any two adjacent fuel inlet apertures.

Referring to FIG. 8, the invention has been applied to a combustion chamber of the tubo or can-annular type in which a number of individual cylindrical combustion chambers 100 are enclosed with an annulus 102 defined by an inner wall 104 and outer wall 106. Each chamber 100 has a closed upstream end provided with a central fuel inlet aperture 108 in which is located a fuel injector 110 and a number of equi-spaced air inlet apertures 112 each having means 114 for imparting a swirling motion to the incoming primary air.

The swirling means 114 can be as described in relation to the embodiment of the invention described above and the operation of the swirling means is such that fuel and primary air are rapidly mixed within a short distance of the upstream end of the combustion chamber.

The direction in which the swirlers rotate the primary air is the same in the case of the embodiments of the invention, illustrated and described, but if circumstances demand it can be arranged for a group or groups of swirlers to rotate the primary air in the opposite direction to that of the remaining group or groups of swirlers. It will be noted that one feature of the present invention is that each fuel injector does not have a co-axial swirling air inlet associated with it and similarly each air inlet and associated swirler does not have an associated co-axial fuel injector. It is a feature of the invention that the air inlet apertures and swirlers are circumferentially or radially spaced away from the fuel injector apertures and thus the fuel injectors, when in use.

I claim:

1. A combustion chamber arrangement for a gas turbine engine comprising:

a combustion chamber having a closed upstream end, an open downstream and dilution air inlets in the wall thereof between said closed upstream end and said open downstream end;

at least one fuel inlet aperture in said closed upstream end of said combustion chamber;

fuel injector means positioned in said fuel inlet aperture for discharging fuel into said combustion chamber on a predetermined axis, said fuel injector means substantially filling said fuel inlet aperture so that any air entering said combustion chamber through said fuel aperture around said fuel injector means is minimal and nonswirled;

a plurality of primary air inlet apertures in said closed upstream end of said combustion chamber through which substantially all primary air is discharged thereto, said at least one fuel inlet aperture being positioned intermediate two of said plurality primary air inlet apertures; and swirl means in each of said plurality of primary air inlet apertures, each of said swirl means imparting a swirling motion to primary air passing therethrough about an axis spaced from said predetermined axis of fuel being discharged by said fuel injector means, and said swirl means in said two of said plurality of primary air inlet apertures swirling air in the same direction of rotation so as to provide a shearing action directly to fuel discharging from said fuel injector means.

2. A combustion chamber arrangement as claimed in claim 1 in which said combustion chamber is annular and its closed upstream end includes a plurality of fuel inlet apertures circumferentially spaced in said annular chamber, each fuel inlet aperture including fuel injector means, and in which said plurality of primary air inlet apertures are circumferentially spaced in said annular chamber with at least one primary air inlet aperture being positioned between adjacent fuel inlet apertures.

3. A combustion chamber arrangement as claimed in claim 2 in which swirl means in each of said primary air inlet apertures impart a swirling motion to the primary air in the same direction of rotation.

4. A combustion chamber arrangement as claimed in claim 2 in which there are at least two primary air inlet apertures positioned between adjacent ones of said fuel inlet apertures.

5. A combustion chamber arrangement as claimed in claim 4 in which said swirling means in some of said primary air inlets is arranged to direct rotation of swirling primary air therefrom in an opposite direction to that imparted by swirling means in the remaining primary air inlet apertures with rotation of primary air on opposite sides of any of said fuel air inlet apertures being in the same direction.

6. A combustion chamber arrangement as claimed in claim 1 in which each of said primary air inlet apertures includes a variable area adjustable deflector through which primary air enters said combustion chamber.

7. A combustion chamber arrangement as claimed in claim 1 in which said swirling means in each of said primary air inlet apertures comprises a plurality of angled vanes.

8. A combustion chamber arrangement as claimed in claim 1 including an annular housing, and in which said combustion chamber includes a plurality of cylindrical combustion chambers equi-spaced circumferentially within said annular housing, each of said cylindrical combustion chambers having in its closed upstream end a central fuel inlet aperture with a fuel injector means therein and in which said plurality of primary air inlet apertures are equi-spaced around said fuel inlet aperture, said swirl means for each of said primary air inlet apertures arranged to swirl primary air in the same direction.

* * * * *